US011664151B2

(12) United States Patent
Imada

(10) Patent No.: US 11,664,151 B2
(45) Date of Patent: May 30, 2023

(54) MULTILAYER COIL COMPONENT

(71) Applicant: Murata Manufacturing Co., Ltd., Kyoto-fu (JP)

(72) Inventor: Katsuhisa Imada, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 547 days.

(21) Appl. No.: 16/245,031

(22) Filed: Jan. 10, 2019

(65) Prior Publication Data

US 2019/0214187 A1 Jul. 11, 2019

(30) Foreign Application Priority Data

Jan. 11, 2018 (JP) ..... JP2018-002978

(51) Int. Cl.
*H01F 27/28* (2006.01)
*H01F 27/29* (2006.01)
(Continued)

(52) U.S. Cl.
CPC ..... *H01F 27/29* (2013.01); *H01F 17/0013* (2013.01); *H01F 17/04* (2013.01); *H01F 27/2804* (2013.01); *H01F 27/292* (2013.01); *H01F 41/043* (2013.01); *H01F 2027/2809* (2013.01)

(58) Field of Classification Search
CPC ..... H01F 17/0013; H01F 17/0006; H01F 2027/2809; H01F 27/2804; H01F 5/003; H01F 27/29; H01F 27/292; H01F 17/04; H01F 27/245; H01F 27/255; H01F 27/30;
(Continued)

(56) References Cited

U.S. PATENT DOCUMENTS 6,380,619 B2 * 4/2002 Ahiko ..... H05K 3/3442 257/703
6,992,556 B2 * 1/2006 Tada ..... H01F 5/003 336/200
(Continued)

FOREIGN PATENT DOCUMENTS

CN 101356598 A 1/2009
CN 104078192 A 10/2014
(Continued)

OTHER PUBLICATIONS

An Office Action issued by the China National Intellectual Property Administration dated Oct. 28, 2020, which corresponds to Chinese Patent Application No. 201910018851.1 and is related to U.S. Appl. No. 16/245,031 with English language translation.
(Continued)

*Primary Examiner* — Tszfung J Chan
(74) *Attorney, Agent, or Firm* — Studebaker & Brackett PC

(57) ABSTRACT

A multilayer coil component includes a body including laminated ferrite layers, a coil conductor including conductive layers laminated in the body, and a pair of outer electrodes disposed on a lower surface of the body. Each of the pair of outer electrodes is electrically connected to a corresponding one of end portions of the coil conductor. Each of the outer electrodes includes an underlying electrode and a plating layer disposed on the underlying electrode. The underlying electrode is disposed at a distance from a side surface of the body.

19 Claims, 10 Drawing Sheets

(51) Int. Cl.
*H01F 41/04* (2006.01)
*H01F 17/00* (2006.01)
*H01F 17/04* (2006.01)

(58) Field of Classification Search
CPC ..... H01F 27/306; H01F 27/027; H01F 27/06; H01F 27/26; H01F 27/266
USPC ..... 336/200, 232
See application file for complete search history.

(56) References Cited

U.S. PATENT DOCUMENTS

| | | | | |
|---|---|---|---|---|
| 8,242,870 | B1 | 8/2012 | Folker | |
| 10,796,837 | B2 | 10/2020 | Ito et al. | |
| 2008/0038562 | A1 | 2/2008 | Ito et al. | |
| 2009/0003191 | A1* | 1/2009 | Inuzuka | H01F 17/0013 369/283 |
| 2009/0115563 | A1* | 5/2009 | Arata | H01F 17/0013 336/200 |
| 2010/0157565 | A1* | 6/2010 | Yoshida | H01F 27/292 361/811 |
| 2011/0279213 | A1 | 11/2011 | Tsuduki et al. | |
| 2013/0200977 | A1* | 8/2013 | Miyazaki | H01F 17/0013 336/192 |
| 2013/0257576 | A1* | 10/2013 | Arata | H01F 17/0013 336/200 |
| 2014/0078643 | A1 | 3/2014 | Odahara | |
| 2014/0292466 | A1 | 10/2014 | Watanabe et al. | |
| 2015/0145629 | A1* | 5/2015 | Chang | H01F 17/0006 336/192 |
| 2015/0294780 | A1 | 10/2015 | Maeda | |
| 2015/0371757 | A1* | 12/2015 | Takezawa | H01F 17/0013 336/200 |
| 2016/0086720 | A1 | 3/2016 | Jeong | |
| 2016/0351314 | A1 | 12/2016 | Jeong et al. | |
| 2017/0103845 | A1 | 4/2017 | Nagai et al. | |
| 2017/0150606 | A1 | 5/2017 | Yoon et al. | |
| 2018/0182536 | A1 | 6/2018 | Tachibana | |
| 2018/0286565 | A1* | 10/2018 | Aoki | H01F 17/0013 |
| 2018/0286566 | A1* | 10/2018 | Aoki | H01F 27/29 |
| 2018/0350505 | A1 | 12/2018 | Ryu et al. | |
| 2019/0006089 | A1* | 1/2019 | Kudo | H01F 17/0013 |
| 2020/0075228 | A1 | 3/2020 | Jeong | |
| 2020/0082986 | A1 | 3/2020 | Yaso | |

FOREIGN PATENT DOCUMENTS

| | | | | |
|---|---|---|---|---|
| CN | 104737245 | A | 6/2015 | |
| CN | 106205972 | A | 12/2016 | |
| CN | 108305760 | A | 7/2018 | |
| JP | 2005-026312 | A | 1/2005 | |
| JP | 2010-278133 | A | 12/2010 | |
| JP | 2011-009391 | A | 1/2011 | |
| JP | 2013-211302 | A | 10/2013 | |
| JP | 2014-150096 | A | 8/2014 | |
| JP | 2015228478 | A * | 12/2015 | H01F 17/0013 |
| JP | 2017-073495 | A | 4/2017 | |
| WO | 2008/018187 | A1 | 2/2008 | |
| WO | 2012/172939 | A1 | 12/2012 | |
| WO | WO-2015186780 | A1 * | 12/2015 | H01F 41/041 |
| WO | WO-2017057246 | A1 * | 4/2017 | C03C 3/064 |
| WO | 2017/212990 | A1 | 12/2017 | |

OTHER PUBLICATIONS

An Office Action issued by the China National Intellectual Property Administration dated Jul. 21, 2020, which corresponds to Chinese Patent Application No. 201910018639.5 and is related to U.S. Appl. No. 16/245,031 with English language translation.

An Office Action; "Notification of Reasons for Refusal," mailed by the Japanese Patent Office dated Apr. 7, 2020, which corresponds to Japanese Patent Application No. 2018-002977 and is related to U.S. Appl. No. 16/245,031 with English language translation.

An Office Action; "Notification of Reasons for Refusal," mailed by the Japanese Patent Office dated Apr. 7, 2020, which corresponds to Japanese Patent Application No. 2018-002976 and is related to U.S. Appl. No. 16/245,031 with English language translation.

An Office Action; "Notification of Reasons for Refusal," mailed by the Japanese Patent Office dated Apr. 7, 2020, which corresponds to Japanese Patent Application No. 2018-002978 and is related to U.S. Appl. No. 16/245,031 with English language translation.

* cited by examiner

MULTILAYER COIL COMPONENT

CROSS-REFERENCE TO RELATED APPLICATION

This application claims benefit of priority to Japanese Patent Application No. 2018-002978, filed Jan. 11, 2018, the entire content of which is incorporated herein by reference.

BACKGROUND

Technical Field

The present disclosure relates to a multilayer coil component.

Background Art

As a multilayer coil component, Japanese Unexamined Patent Application Publication No. 2011-9391 discloses a multilayer coil component including a multilayer body in which insulating layers having a substantially rectangular shape are laminated, a coil conductor disposed in the multilayer body, the coil conductor having a first end portion and a second end portion, the first end portion being located above the second end portion, and outer electrodes disposed on the lower surface of the multilayer body.

The multilayer coil component as described above includes outer electrodes on a lower surface thereof. The outer electrodes extend to end faces of the multilayer body. Thus, for example, when the multilayer coil component is subjected to barrel processing, the outer electrodes may be peeled off by impact.

SUMMARY

Accordingly, the present disclosure provides a multilayer coil component including outer electrodes that are less likely to peel off.

The inventor has conducted intensive studies in order to solve the foregoing problems and has found that in a multilayer coil component, the peeling-off of outer electrodes can be inhibited by arranging the outer electrodes at a distance from side surfaces of a body.

According to preferred embodiments of the present disclosure, a multilayer coil component includes a body including laminated ferrite layers, a coil conductor including conductive layers laminated in the body, and a pair of outer electrodes disposed on a lower surface of the body. Each of the pair of outer electrodes is electrically connected to a corresponding one of end portions of the coil conductor, in which each of the outer electrodes includes an underlying electrode and a plating layer disposed on the underlying electrode, and the underlying electrode is disposed at a distance from a side surface of the body.

Other features, elements, characteristics and advantages of the present disclosure will become more apparent from the following detailed description of preferred embodiments of the present disclosure with reference to the attached drawings.

DETAILED DESCRIPTION

Figure 1:
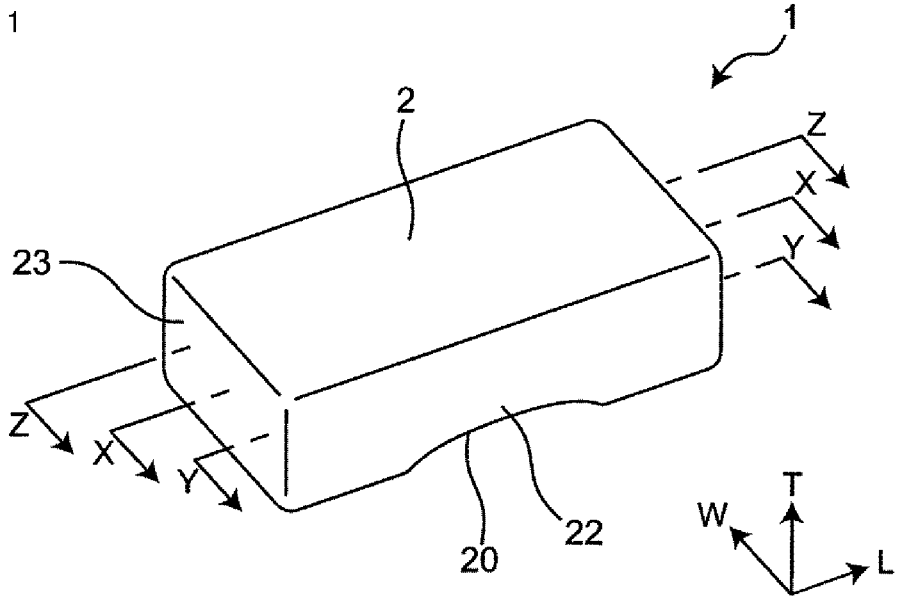
FIG. 1 is a perspective view of a multilayer coil component according to an embodiment of the present disclosure.

A multilayer coil component and a method for producing the multilayer coil component disclosed in this specification will be described below with reference to the attached drawings. It should be noted, however, that the structure, shape, number of turns, relative positions, and the like of the multilayer coil component of the present disclosure are not limited to the examples illustrated in the drawings.

Figure 2:
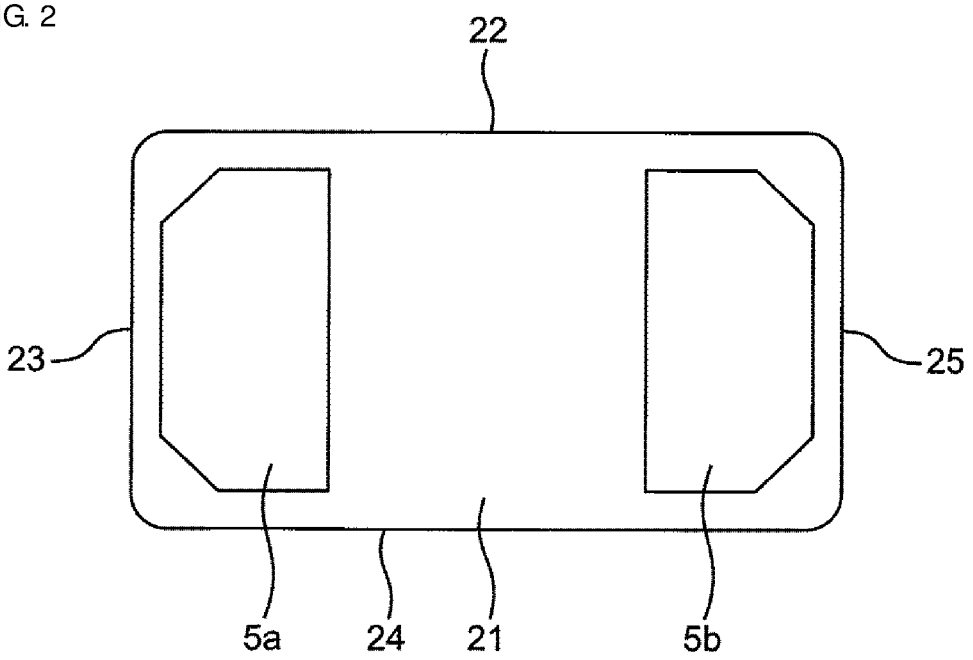
FIG. 2 is a bottom view of the multilayer coil component according to the embodiment illustrated in FIG. 1.
Figure 3:
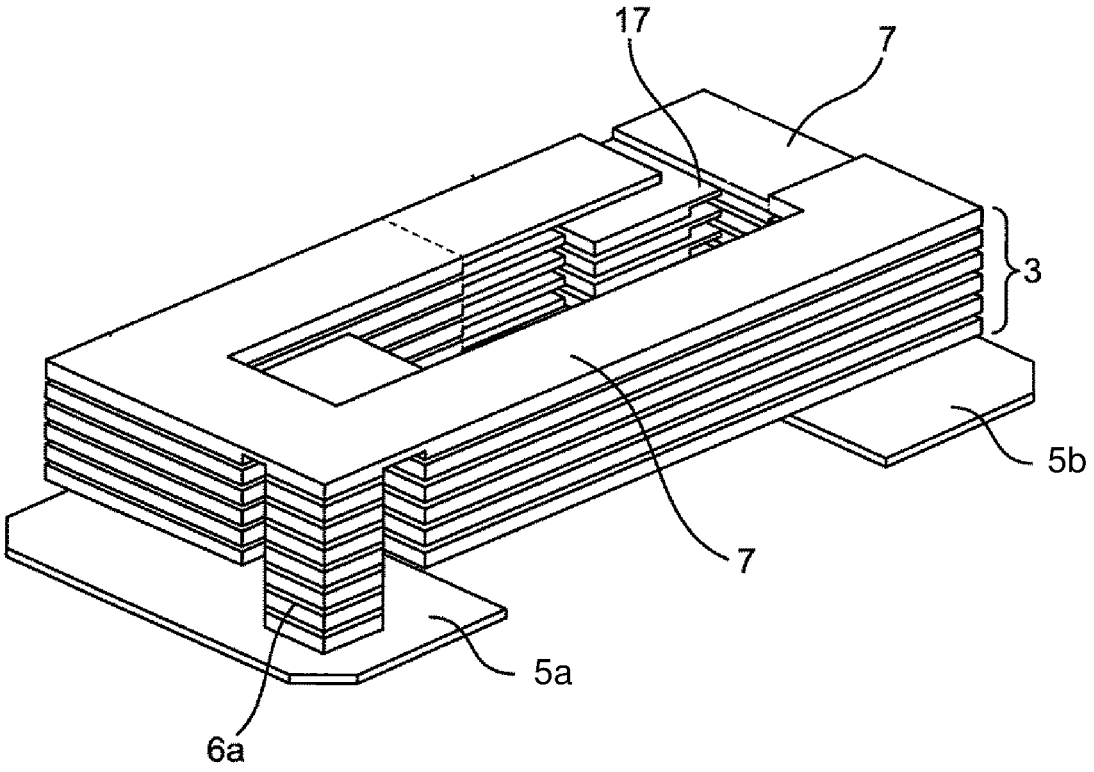
FIG. 3 is a perspective view illustrating the coil conductor, the lead electrode, and underlying electrodes of the multilayer coil component according to the embodiment illustrated in FIG. 1.
Figure 4:
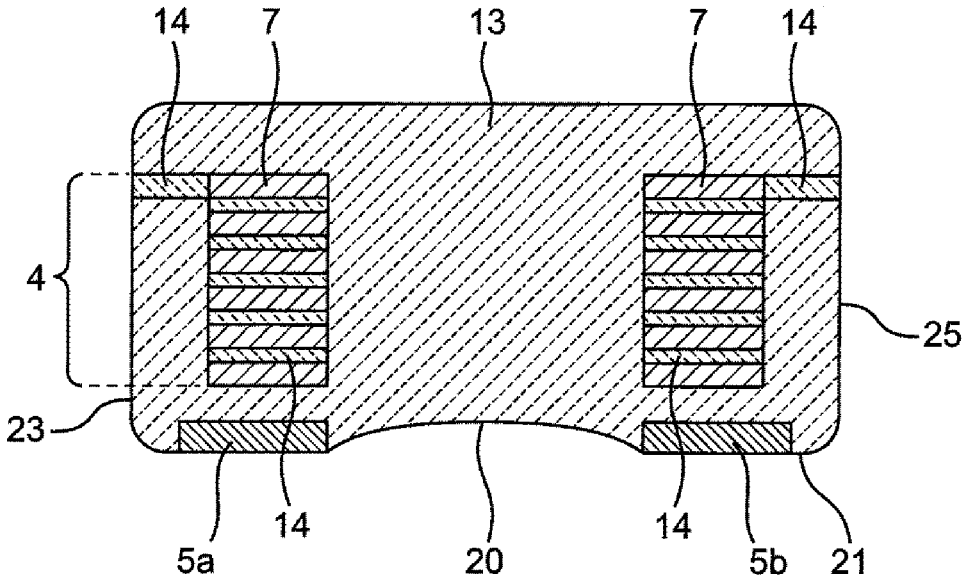
FIG. 4 is a cross-sectional view of the multilayer coil component according to the embodiment illustrated in FIG. 1, the cross-sectional view being taken along line X-X of FIG. 1.
Figure 5:
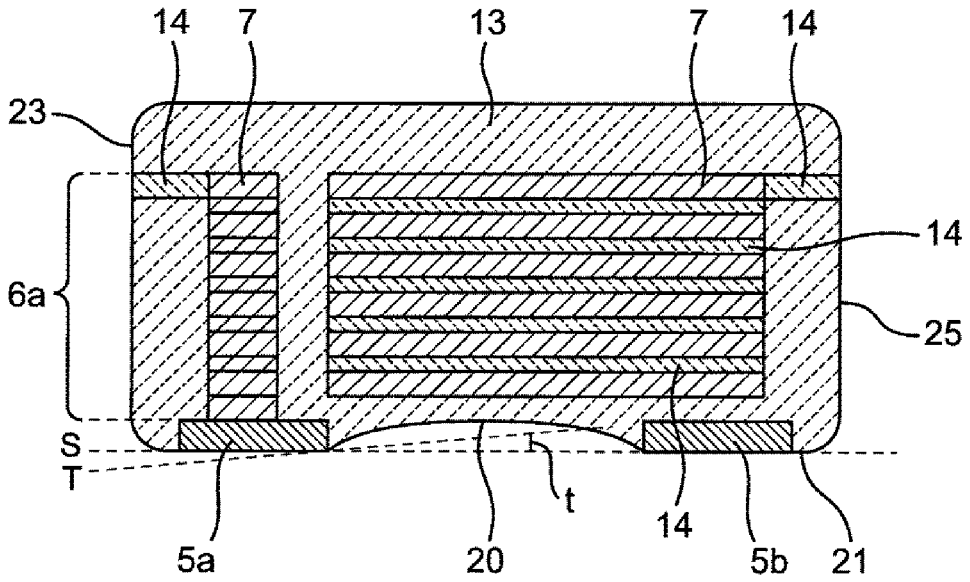
FIG. 5 is a cross-sectional view of the multilayer coil component according to the embodiment illustrated in FIG. 1, the cross-sectional view being taken along line Y-Y of FIG. 1.
Figure 6:
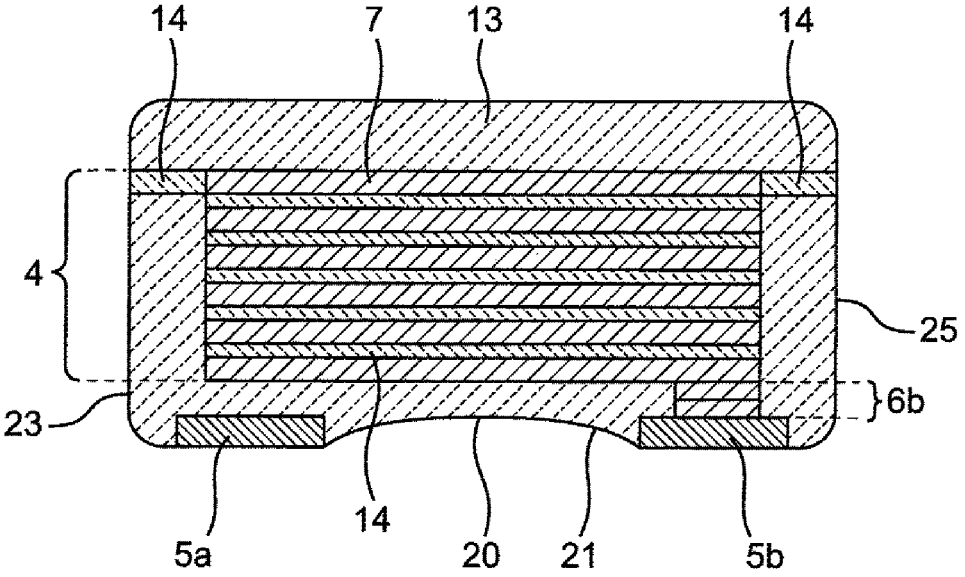
FIG. 6 is a cross-sectional view of the multilayer coil component according to the embodiment illustrated in FIG. 1, the cross-sectional view being taken along line Z-Z of FIG. 1.

As illustrated in FIGS. 1 to 6, the multilayer coil component 1 according to this embodiment roughly includes a body 2, a coil conductor 3 embedded in the body 2, and a pair of outer electrodes 5*a* and 5*b* disposed on the lower surface 21 (for example, a surface on the lower side of FIG. 4) of the body 2. As illustrated in FIG. 3, the coil conductor 3 includes the conductive layers 7 that are laminated in the body 2 and that are connected together in the form of a coil. The outer electrodes 5*a* and 5*b* are located at the respective end portions of the lower surface 21. As illustrated in FIGS. 5 and 6, one end portion of the coil conductor 3 is electrically connected to the outer electrode 5*a* through a lead electrode 6*a*, and the other end portion of the coil conductor 3 is electrically connected to the outer electrode 5*b* through a lead electrode 6*b*. The lower surface 21 includes a recessed section 20 between the outer electrodes 5*a* and 5*b*.

The body 2 is formed of a multilayer ferrite body and includes magnetic ferrite layers (hereinafter, also referred to as "magnetic layers") 13 and non-magnetic ferrite layers (hereinafter, also referred to as "non-magnetic layers") 14. Hereinafter, the magnetic ferrite layers and the non-magnetic ferrite layers are collectively referred to as "ferrite layers".

The non-magnetic ferrite layers 14 are disposed between vertically adjacent conductive layers 7 in the body 2. That is, the conductive layer 7, the non-magnetic ferrite layer 14, and the conductive layer 7 are laminated in this order. The non-magnetic ferrite layers 14 are interposed between the conductive layers 7. The arrangement of the non-magnetic ferrite layers 14 between the conductive layers 7 as described above results in the blockage of magnetic flux passing through a region around the conductive layers 7; thus, the multilayer coil component has improved direct current superposition characteristics.

One of the non-magnetic ferrite layers 14 in the body 2 is disposed at the outer side portion of the uppermost layer, i.e., the layer disposed at the top in FIG. 4, of the conductive layers 7. In other words, the non-magnetic ferrite layer 14 is disposed between the conductive layers 7 and the side surfaces of the body 2. The non-magnetic ferrite layer 14 disposed at the position is disposed at the entire portion located between the uppermost layer of the conductive layers 7 and the side surfaces 22, 23, 24, and 25 of the body 2. The non-magnetic ferrite layer 14 vertically partitions the magnetic ferrite layers 13 at the outer side portion of the winding section 4 of the coil conductor 3. As described above, the non-magnetic ferrite layer 14 is disposed at the outer side portion of the winding section 4 of the coil conductor 3 and in the entire portion located between the coil conductor 3 and the side surfaces of the body 2, so that the magnetic flux of the coil conductor 3 can be blocked. Thus, the multilayer coil component has improved direct current superposition characteristics. Here, the term "winding section" refers to a section where the conductive layers of the coil conductor are wound in the form of a coil.

The magnetic ferrite layers 13 are disposed at a portion of the body 2 other than a portion where the non-magnetic ferrite layers 14 are disposed. In other words, the inner side portion of the winding section 4 of the coil conductor 3 is occupied by the magnetic ferrite layers 13. Because the inner side portion of the winding section 4 of the coil conductor is formed of the magnetic ferrite layers 13, the multilayer coil component can have increased inductance.

The lower surface 21 of the body 2 has the recessed section 20 between the pair of outer electrodes 5*a* and 5*b*. In the multilayer coil component 1, the presence of the recessed section 20 of the lower surface between the outer electrodes 5*a* and 5*b* can improve the entry of a potting resin, thereby inhibiting the formation of a void.

The recessed section 20 preferably has a depth of about 0.01 mm or more and about 0.10 mm or less (i.e., from about 0.01 mm to about 0.10 mm), more preferably about 0.03 mm or more and about 0.08 mm or less (i.e., from about 0.03 mm or more and about 0.08 mm).

The depth of the recessed section 20 can be measured as described below.

A sample of the multilayer coil component is vertically placed. The sample is sealed with a resin in such a manner that an LT side surface, for example, the side surface 22, is exposed.

The sample is polished with a polishing machine to a depth of about ½ of the width of the sample in the W direction to expose an LT section.

The polished surface of the sample is photographed with a scanning electron microscope (SEM).

A reference line connecting lower portions (lowermost portions) of the outer electrodes 5*a* and 5*b* is drawn. The largest distance between the reference line and the lower surface 21 of the body is measured. The distance is defined as the depth of the recessed section. The recessed section 20 preferably has a tapered portion. The tapered portion preferably has a taper angle of about 3° or more and about 10° or less (i.e., from about 3° to about 10°), more preferably about 4° or more and about 8° or less (i.e., from about 4° to about 8°).

The tapered portion can be measured as described below.

As with the case of measuring the depth of the recessed section, a sample of the multilayer coil component is vertically placed. The sample is sealed with a resin in such a manner that an LT side surface, for example, the side surface 22, is exposed.

The sample is polished with a polishing machine to a depth of about ½ of the width of the sample in the W direction to expose an LT section.

The polished surface of the sample is photographed with a scanning electron microscope (SEM).

As illustrated in FIG. 5, a reference line S connecting lower portions (lowermost portions) of the outer electrodes 5*a* and 5*b* is drawn. A tangent T to the peripheral wall surface of the recessed section is drawn at the point of intersection of the reference line S and the edge of the recessed section between the outer electrodes 5*a* and 5*b*. An angle t between the reference line and the tangent is measured and defined as the taper angle.

In the present disclosure, the recessed section is not indispensable and may be not provided.

The magnetic ferrite layers 13 may be composed of a material such as, but not particularly limited to, sintered ferrite mainly containing Fe, Zn, Cu, and Ni. The non-magnetic ferrite layers 14 may be composed of a material such as, but not particularly limited to, sintered ferrite mainly containing Fe, Cu, and Zn.

While the body 2 includes the magnetic ferrite layers 13 and the non-magnetic ferrite layers 14 in this embodiment, the present disclosure is not limited to the embodiment. The body 2 may be formed of laminated ferrite layers. For example, the body 2 may be formed of the magnetic ferrite layers 13, none of the non-magnetic ferrite layers 14 being present in the body 2.

The coil conductor 3 includes the conductive layers 7 laminated in the body 2 in the form of a coil, the conductive layers 7 being connected through connection conductors 17.

One end portion of the coil conductor 3 is located at the upper side portion of the body 2. In other words, the one end portion is adjacent to a surface opposite to the surface on which the outer electrodes are disposed. The other end portion is located at the lower side portion of the body 2. In other words, the other end portion is adjacent to the surface on which the outer electrodes are disposed. The coil conductor 3 is formed in such a manner that the axis of the coil extends in the lamination direction of the body (vertical direction in FIG. 4).

The conductive layers 7 may be composed of any conductive material containing a conductive metal and is preferably composed of a conductive material mainly containing Cu or Ag, more preferably a conductive material mainly containing Ag. For example, the conductive layers are composed of a conductive material having a conductive metal content of about 98.0% by mass to about 99.9% by mass.

According to an embodiment, at least one of the conductive layers 7 has constricted portions at end portions thereof. The shape of the constricted portions is not particularly limited and is preferably a substantially wedge shape.

Figure 7:
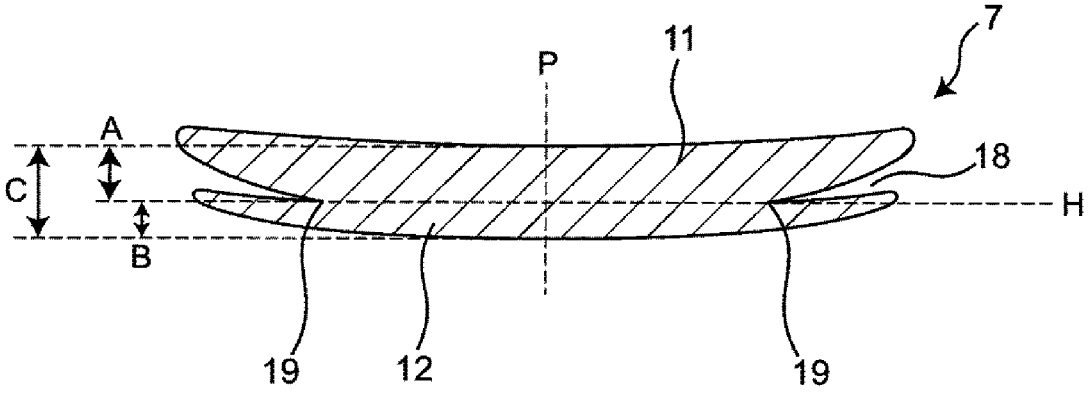
FIG. 7 is an enlarged sectional view of conductive layers of the multilayer coil component according to the embodiment illustrated in FIG. 1.

As illustrated in FIG. 7, each of the conductive layers 7 according to an embodiment includes a first conductive layer 11 and a second conductive layer 12. Because each of the conductive layers 7 is formed by separately forming the two layers, stresses applied to the respective first conductive layer 11 and the second conductive layer 12 are low, compared with when a single conductive layer having a thickness equal to the total thickness of the two layers is formed. This can suppress the occurrence of cracking in the body 2.

According to an embodiment, the second conductive layer 12 has a smaller thickness than the first conductive layer 11. The first conductive layer 11 and the second conductive layer 12 have different thicknesses. Thus, even if cracking occurs in the body, a crack is generated in the first conductive layer 11 to which a greater stress is applied, propagates toward the thin second conductive layer 12, and stops propagating at the boundary with the second conductive layer 12, thereby being able to inhibit failure due to the occurrence of cracking.

At least one of the conductive layers 7 according to an embodiment has the constricted portions between the first conductive layer 11 and the second conductive layer 12. In each of the conductive layers 7 according to a preferred embodiment, the thin second conductive layer 12 is disposed on the side of the lower surface on which the outer electrodes are disposed.

The thickness of each of the conductive layers 7 is preferably, but not necessarily, about 15 μm or more and 45 μm or less (i.e., from about 15 μm to 45 μm), more preferably about 20 μm or more and about 40 μm or less (i.e., from about 20 μm to about 40 μm). When each of the conductive layers 7 is formed of the first conductive layer 11 and the second conductive layer 12, the thicker first conductive layer 11 preferably has a thickness of about 55% or more and about 70% or less (i.e., from about 55% to about 70%), more preferably about 55% or more and about 65% or less (i.e., from about 55% to about 65%) of the overall thickness of the conductive layer 7.

The thicknesses of the conductive layers 7, the first conductive layer 11, and the second conductive layer 12 can be measured as described below.

As with the case of measuring the depth of the recessed section, a sample of the multilayer coil component is vertically placed. The sample is sealed with a resin in such a manner that an LT side surface, for example, the side surface 22, is exposed.

The sample is polished with a polishing machine to a depth of about ½ of the width of the sample in the W direction to expose an LT section.

The polished surface of the sample is photographed with a scanning electron microscope (SEM).

As illustrated in FIG. 7, end portions 19 of the wedge-shaped constricted portions 18 located between the laminated first and second conductive layers 11 and 12 and at the left and right portions of the laminated first and second conductive layers 11 and 12 are connected with a line to provide reference line H. Perpendicular bisector P of a segment of reference line H between the end portions 19 is drawn. Distances between reference line H and a surface of the first conductive layer 11 and between reference line H and a surface of the second conductive layer 12 are measured. Specifically, length A and length B illustrated in FIG. 7 are measured.

Length A between the reference line H and the surface of the first conductive layer 11 is defined as the thickness of the first conductive layer 11. Length B between the reference line H and the surface of the second conductive layer 12 is defined as the thickness of the second conductive layer 12. Total thickness C of the first conductive layer 11 and the second conductive layer 12 is defined as the thickness of each of the conductive layers 7.

According to an embodiment, the first conductive layer 11 has a higher pore area percentage than the second conductive layer 12. The use of an electrode portion having a high pore area percentage can reduce stress concentration. When the first conductive layer 11 has a higher pore area percentage than the second conductive layer 12, the thin second conductive layer 12 is relatively dense, thus suppressing an increase in direct-current resistance.

According to an embodiment, the second conductive layer 12 preferably has a pore area percentage of about 1% or more and about 5% or less (i.e., from about 1% to about 5%), more preferably about 1% or more and about 4% or less (i.e., from about 1% to about 4%). The first conductive layer 11 preferably has a pore area percentage of about 3% or more and about 8% or less (i.e., from about 3% to about 8%), more preferably about 4% or more and about 6% or less (i.e., from about 4% to about 6%).

The pore area percentage can be measured as described below.

As with the case of measuring the depth of the recessed section, a sample of the multilayer coil component is vertically placed. The sample is sealed with a resin in such a manner that an LT side surface, for example, the side surface 22, is exposed.

The sample is polished with a polishing machine to a depth of about ½ of the width of the sample in the W direction to expose an LT section.

The polished surface of the sample is photographed with a scanning electron microscope (SEM).

As illustrated in FIG. 7, the end portions 19 of the wedge-shaped constricted portions 18 located between the laminated first and second conductive layers 11 and 12 and at the left and right portions of the laminated first and second conductive layers 11 and 12 are connected with a line to provide reference line H. Reference line H is defined as the boundary between first conductive layer 11 and the second conductive layer 12.

All the regions of the first conductive layer 11 and the second conductive layer 12 in the resulting SEM image are analyzed using image analysis software such as Azo-kun (registered trademark) available from Asahi Kasei Engineering Corporation. For each of the first conductive layer 11 and the second conductive layer 12, the percentage of area occupied by pores with respect to the total area is determined and defined as the pore area percentage.

According to an embodiment, at least one of the conductive layers 7 is curved in a substantially arc shape. According to a preferred embodiment, the at least one curved conductive layer 7 preferably has a substantially convex surface facing toward the lower surface on which the outer electrodes are disposed.

According to an embodiment, at least one of the first conductive layer 11 and the second conductive layer 12 is curved in a substantially arc shape. According to a preferred embodiment, each of the first conductive layer 11 and the second conductive layer 12 is curved in a substantially arc shape. Each of the curved first and second conductive layers 11 and 12 preferably has a substantially convex surface facing toward the lower surface on which the outer electrodes are disposed.

The outer electrodes 5*a* and 5*b* are located on the respective left and right end portions of the lower surface 21. The outer electrodes 5*a* and 5*b* are electrically connected to the respective end portions of the coil conductor 3 through the respective lead electrodes 6*a* and 6*b*.

In this embodiment, each of the outer electrodes 5*a* and 5*b* is formed of an underlying electrode 8 and a plating layer 9 disposed thereon. The underlying electrodes 8 are disposed at a distance from the side surfaces of the body 2. When the multilayer coil component 1 is viewed in plan from the lower surface, portions of the lower surface 21 of the body 2 that is not covered with the underlying electrodes are provided around the underlying electrodes 8. The underlying electrodes 8 are disposed at a distance from the side surfaces of the multilayer coil component 1 as just described. This can suppress the peeling-off of the underlying electrodes 8 due to impact or the like.

The distance between the underlying electrodes 8 and the side surfaces of the body 2 (hereinafter, also referred to as a "side-gap distance") may be preferably, but not necessarily, about 5 μm or more and about 100 μm or less (i.e., from about 5 μm to about 100 μm), more preferably about 20 μm or more and about 80 μm or less (i.e., from about 20 μm to about 80 μm).

According to an embodiment, the underlying electrodes 8 have a shape in which portions of the underlying electrodes 8 close to corner portions of the body 2 are cut off when viewed in plan from the lower surface. That is, the underlying electrodes 8 have cutout portions close to corner portions of the body 2 when viewed in plan. Because the underlying electrodes have the shape in which the portions thereof close to the corner portions of the body are cut off, even if the corner portions of the body are scraped during barreling, the exposure of the outer electrodes at the side surfaces can be inhibited.

According to an embodiment, the underlying electrodes 8 have a substantially hexagonal shape in which two corner portions of a substantially rectangle shape are cut off as illustrated in FIGS. 2 and 3. The underlying electrodes 8 are arranged in such a manner that the cut-off portions face the corner portions of the body 2.

Figure 8:
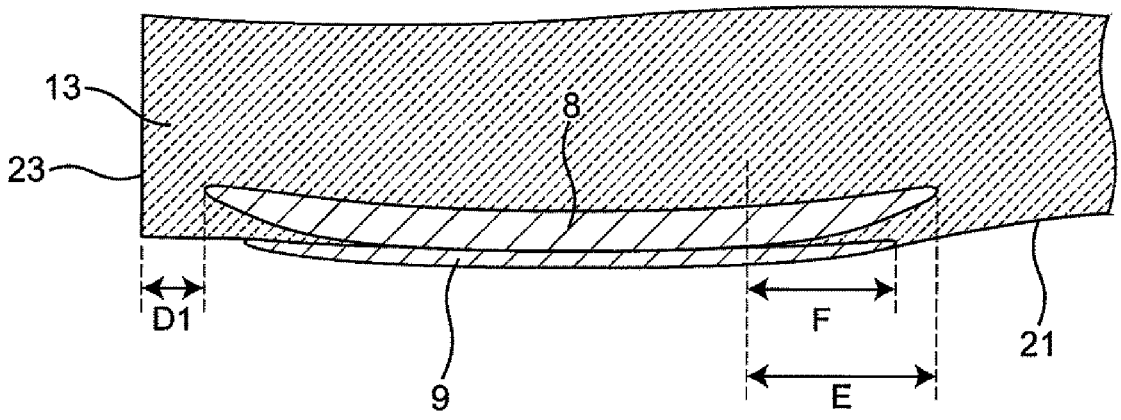
FIG. 8 is an enlarged sectional view of the vicinity of the outer electrode of the multilayer coil component according to the embodiment illustrated in FIG. 1.

According to an embodiment, as illustrated in FIG. 8, the ferrite layer of the body 2 extends on outer edge portions of the underlying electrode 8 across the boundary with the underlying electrode 8. Because the ferrite layer of the body extends onto the underlying electrode, the peeling-off of the underlying electrode can be more inhibited.

The extension distance of the ferrite layer on each of the underlying electrodes 8 may be preferably, but not necessarily, about 10 μm or more and about 90 μm or less (i.e., from about 10 μm to about 90 μm), more preferably about 20 μm and about 80 μm or less (i.e., from about 20 μm to about 80 μm).

The plating layers 9 are disposed on the respective underlying electrodes 8.

According to an embodiment, as illustrated in FIG. 8, the plating layer 9 extends on the ferrite layer across the boundary with the ferrite layer extending on the underlying electrode 8. In other words, at the outer edge portions of the plating layer 9, the ferrite layer is interposed between the plating layer 9 and the underlying electrode 8. The ferrite layer may be a magnetic layer or non-magnetic layer.

The plating growth distance of the plating layer extending on the ferrite layer may be preferably, but not necessarily, about 5 μm or more and about 60 μm or less (i.e., from about 5 μm to about 60 μm), more preferably about 20 μm or more and about 50 μm or less (i.e., from about 20 μm to about 50 μm). The growth of the plating layer onto the ferrite layer can further inhibit the peeling-off of the underlying electrodes 8.

The side-gap distance, the extension distance, and the plating growth distance can be measured as described below.

As with the case of measuring the depth of the recessed section, a sample of the multilayer coil component is vertically placed. The sample is sealed with a resin in such a manner that an LT side surface, for example, the side surface 22, is exposed.

The sample is polished with a polishing machine to a depth of about ½ of the width of the sample in the W direction to expose an LT section.

The polished surface of the sample is photographed with a scanning electron microscope (SEM).

Distance D1 (FIG. 8) between an end portion of the underlying electrode and a side surface is measured and defined as the side-gap distance.

Distance E (FIG. 8) between an end portion of the underlying electrode and an end portion of the ferrite layer extending on the underlying electrode is measured and defined as the extension distance.

Distance F (FIG. 8) between the end portion of the ferrite layer extending on the underlying electrode and an end portion of the plating layer extending on the ferrite layer is measured and defined as the plating growth distance.

The underlying electrodes 8 may be composed of any conductive material containing a conductive metal and is preferably composed of a conductive material mainly containing Cu or Ag, more preferably a conductive material mainly containing Ag.

According to an embodiment, the underlying electrodes 8 contain a glass component. The underlying electrodes contain glass and thus can have improved adhesion to the body, thus preventing the peeling-off of the underlying electrodes.

Non-limiting examples of the glass component include glasses containing $SiO_2$, $B_2O_3$, $K_2O$, $Li_2O$, CaO, ZnO, $Bi_2O_3$, and/or $Al_2O_3$.

The glass component content may be preferably about 0.8% or more by mass and about 1.2% or less by mass (i.e., from about 0.8% by mass to about 1.2% by mass), more preferably about 0.9% or more by mass and about 1.1% or less by mass (i.e., from about 0.9% by mass to about 1.1% by mass) based on the total of the conductive metal and the glass. A glass component content of about 0.8% or more by mass results in improved adhesion between the underlying electrodes and the body. A glass component content of about 1.2% or less by mass results in improved adhesion between the underlying electrodes and the plating layers.

The plating layers 9 are not particularly limited, but contain at least one of Ni and Sn.

According to an embodiment, the underlying electrodes 8 are composed of Ag, and each of the plating layers 9 is composed of Ni and Sn.

The lead electrodes 6*a* and 6*b* are electrically connected between the respective end portions of the coil conductor 3 and the respective outer electrodes 5*a* and 5*b*. The lead electrodes may be composed of any conductive material containing a conductive metal and is preferably composed of a conductive material mainly containing Cu or Ag, more preferably a conductive material mainly containing Ag. For example, the lead electrodes are composed of a conductive material having a conductive metal content of about 98.0% by mass to about 99.9% by mass.

According to an embodiment, none of the lead electrodes 6*a* and 6*b* are disposed at inner side portion of the winding section of the coil conductor 3. Because none of the lead electrodes 6*a* and 6*b* are disposed at the inner side portion of the winding section of the coil conductor 3, the multilayer coil component can have increased inductance. Furthermore, the multilayer coil component can have reduced stray capacitance.

According to an embodiment, the lead electrode 6*a* extends through the outer side portion of the winding section of the coil conductor 3 and is connected between the outer electrode 5*a* and the upper end portion of the coil conductor 3. In other words, the upper end portion of the coil conductor 3 is connected to the outer electrode 5*a* through the lead electrode 6*a* disposed at the outer side portion of the winding section 4 of the coil conductor 3. Because the lead electrode extends through the outer side portion of the winding section of the coil conductor 3, the multilayer coil component can have increased inductance. Furthermore, the multilayer coil component can have reduced stray capacitance.

In a preferred embodiment, the lead electrode 6*a* is disposed at the outer side portion of the winding section of the coil conductor 3. One end portion of the lead electrode 6*a* is electrically connected to the upper end portion of the coil conductor 3, and the other end thereof is electrically connected to the outer electrode 5*a*. One end portion of the lead electrode 6*b* is electrically connected to the lower end portion of the coil conductor 3, and the other end thereof is electrically connected to the outer electrode 5*b*. A portion of the winding section of the coil conductor 3 facing the lead electrode 6*a* is recessed inward in order to sufficiently achieve a distance from the lead electrode 6*a*. In this portion, the distance between the coil conductor 3 and the lead electrode 6*a* is preferably about 50 μm or more, more preferably about 60 μm or more. The upper limit of the distance between the coil conductor 3 and the lead electrode 6*a* may be, but is not particularly limited to, for example, about 100 μm or less. Non-limiting examples of the shape of the recessed portion include substantially angular shapes and substantially arch shapes.

According to an embodiment, the lead electrode 6*a* has a shape in which a portion thereof close to the coil conductor 3 is cut off or recessed when viewed in plan in the lamination direction. In other words, the lead electrode 6*a* has a cutout portion close to the coil conductor 3 when viewed in plan in the lamination direction. Examples of the shape may include a substantially pentagonal shape in which one corner of a substantially rectangle is cut off, and a shape recessed along the shape of the winding section of the coil conductor 3. Because the lead electrode has the shape in which the portion close to the coil conductor 3 is cut off or recessed, the multilayer coil component has a large distance between the coil conductor and the lead electrode and thus improved reliability.

The lead electrodes 6*a* and 6*b* may be formed in the same way as for the conductive layers 7 and may have the same characteristics as the conductive layers 7. For example, according to an embodiment, the lead electrodes 6*a* and 6*b* may have wedge-shaped recessed portions on side surfaces thereof. The arrangement of the wedge-shaped recessed portions on the side surfaces of the lead electrodes results in low stress, compared with the case where no recessed portion is provided. This can suppress the occurrence of cracking in the body 2.

For example, according to an embodiment, the lead electrodes 6*a* and 6*b* may have a structure in which two types of electrode layers are alternately laminated. The two types of electrode layers may be the same as the first conductive layer 11 and the second conductive layer 12 included in the conductive layers 7.

For example, the multilayer coil component 1 according to this embodiment is produced as described below.

First, a magnetic material is provided. The composition of the magnetic material may preferably contain, but not necessarily, Fe, Zn, Cu, and Ni serving as main components. Typically, the magnetic material may be prepared by mixing $Fe_2O_3$, ZnO, CuO, and NiO powders, serving as raw materials, together in a desired ratio and calcining the mixture. However, the magnetic material is not limited thereto.

According to an embodiment, the main components of the magnetic material are oxides of Fe, Zn, Cu, and Ni (ideally, $Fe_2O_3$, ZnO, CuO, and NiO). The magnetic material may have, in terms of $Fe_2O_3$, an Fe content of about 40.0% or more by mole and about 49.5% or less by mole (i.e., from about 40.0% by mole to about 49.5% by mole) (with respect to the total of the main components, the same is true for the following), preferably about 45.0% or more by mole and about 49.5% or less by mole (i.e., from about 45.0% by mole to about 49.5% by mole).

The magnetic material may have, in terms of ZnO, a Zn content of about 2.0% or more by mole and about 35.0% or less by mole (i.e., from about 2.0% by mole to about 35.0% by mole) (with respect to the total of the main components, the same is true for the following), preferably about 10.0% or more by mole and about 30.0% or less by mole (i.e., from about 10.0% by mole to about 30.0% by mole).

The magnetic material may have, in terms of CuO, a Cu content of about 6.0% or more by mole and about 13.0% or less by mole (i.e., from about 6.0% by mole to about 13.0% by mole) (with respect to the total of the main components, the same is true for the following), preferably about 7.0% or more by mole and about 10.0% or less by mole (i.e., from about 7.0% by mole to about 10.% by mole).

The Ni content of the magnetic material is not particularly limited and may be the balance of Fe, Zn, and Cu serving as the other main components.

Separately, a non-magnetic material is provided. The composition of the non-magnetic material may preferably contain, but not necessarily, Fe, Cu, and Zn serving as main components. Typically, the non-magnetic material may be prepared by mixing $Fe_2O_3$, CuO, and ZnO powders, serving as raw materials, together in a desired ratio and calcining the mixture. However, the non-magnetic material is not limited thereto.

The non-magnetic material may have, in terms of $Fe_2O_3$, an Fe content of about 40.0% or more by mole and about 49.5% or less by mole (i.e., from about 40.0% by mole to about 49.5% by mole) (with respect to the total of the main components, the same is true for the following), preferably about 45.0% or more by mole and about 49.5% or less by mole (i.e., from about 45.0% by mole to about 49.5% by mole).

The non-magnetic material may have, in terms of CuO, a Cu content of about 6.0% or more by mole and about 12.0% or less by mole (i.e., from about 6.0% by mole to about 12.0% by mole) (with respect to the total of the main components, the same is true for the following), preferably about 7.0% or more by mole and about 10.0% or less by mole (i.e., from about 7.0% by mole to about 10.0% by mole).

The Zn content of non-magnetic material in terms of ZnO is not particularly limited and may be the balance of Fe and Cu serving as the other main components.

In this disclosure, the magnetic material and the non-magnetic material (hereinafter, also referred collectively as "ferrite materials") may further contain an additive component. Non-limiting examples of the additive components for the ferrite materials include Mn, Co, Sn, Bi, and Si. The Mn, Co, Sn, Bi, and Si contents (amounts added) are, in terms of $Mn_3O_4$, $Co_3O_4$, $SnO_2$, $Bi_2O_3$, and $SiO_2$, respectively, preferably about 0.1 parts by weight or more and about 1 part by weight or less (i.e., from about 0.1 parts by weight to about 1 part by weight) with respect to 100 parts by weight of the total of the main components, i.e., Fe (in terms of $Fe_2O_3$), Zn (in terms of ZnO), Cu (in terms of CuO), and Ni (in terms of NiO).

Regarding before and after sintering of the magnetic material into a magnetic layer and before and after sintering of the non-magnetic material into a non-magnetic layer, for example, CuO and $Fe_2O_3$ in the magnetic and non-magnetic materials before sintering may be partially changed into $Cu_2O$ and $Fe_3O_4$, respectively, by firing. However, it is safe to assume that the contents of the main components in the magnetic layer and the non-magnetic layer after sintering are substantially equal to the contents of the main components in the magnetic material and the non-magnetic material before sintering. Specifically, for example, it is safe to assume that the Cu content in terms of CuO and the Fe content in terms of $Fe_2O_3$ after sintering are substantially equal to the CuO content and the $Fe_2O_3$ content, respectively, before sintering.

The magnetic material and the non-magnetic material may contain unavoidable impurities.

A magnetic paste is provided using the magnetic material. For example, the magnetic paste may be prepared by mixing, kneading, and dispersing the magnetic material with a binder resin such as polyvinyl acetal, an organic solvent such as a ketone-based solvent, and a plasticizer such as an alkyd-based plasticizer. However, the magnetic paste is not limited thereto. Similarly, a non-magnetic paste is provided using the non-magnetic material in place of the magnetic material.

Separately, a conductive paste for the conductive layers and the lead electrodes is provided. For example, the conductive paste is, but not particularly limited to, a paste containing Ag or Cu, preferably a paste containing Ag. For example, the conductive paste may be prepared by mixing, kneading, and dispersing Ag with a binder resin such as ethyl cellulose, an organic solvent such as eugenol, and a dispersant. However, the conductive paste is not limited thereto. A common, commercially available copper or silver paste containing a Cu or Ag powder may be used.

According to an embodiment, two types of conductive pastes are provided. Specifically, two types of conductive pastes having different shrinkages during firing are provided.

According to an embodiment, a conductive paste having a relatively low shrinkage of, for example, about 10% or more and about 15% or less (i.e., from about 10% to about 15%) is used as a first conductive paste. A conductive paste having a relatively high shrinkage of, for example, about 20% or more and about 25% or less (i.e., from about 20% to about 25%) is used as a second conductive paste.

The shrinkage can be adjusted by changing a pigment volume concentration (PVC), which is a volume concentration of a conductive powder with respect to the total volume of the conductive powder and a resin component. The use of the two types of conductive pastes having different shrinkages can form layers having different thicknesses after sintering.

The shrinkage can be determined as follows: A conductive paste is applied to a polyethylene terephthalate (PET) film, dried, and cut into a sample measuring 5 mm×5 mm. Then changes in sample dimensions are measured with a thermomechanical analyzer (TMA).

A conductive paste for the underlying electrodes is provided. For example, the conductive paste for the underlying electrodes is, but not particularly limited to, a paste containing a conductive metal such as Ag or Cu, preferably a paste containing Ag. As the conductive paste for the underlying electrodes, a paste further containing glass is preferred. For example, the conductive paste may be prepared by mixing, kneading, and dispersing Ag and glass with a binder resin such as ethyl cellulose, an organic solvent such as eugenol, and a dispersant. However, the conductive paste is not limited thereto.

When the conductive paste for the underlying electrodes contains glass, the glass content may be preferably about 0.8% or more by mass and about 1.2% or less by mass (i.e., from about 0.8% by mass to about 1.2% by mass), more preferably about 0.9% or more by mass and about 1.1% or less by mass (i.e., from about 0.9% by mass to about 1.1% by mass) with respect to the total of the conductive metal and the glass.

Next, a multilayer body is formed using the magnetic paste, the non-magnetic paste, and the conductive pastes. The formation of the multilayer body will be described below with reference to FIGS. 9A to 10D.

In this embodiment, the formation is started from an upper surface 26 (upper surface in FIG. 4). While one multilayer body is illustrated in FIGS. 9A to 9K, a collection of multilayer bodies can be formed on a sheet.

The magnetic paste is formed into a sheet, thereby providing a magnetic sheet.

Figure 9A:
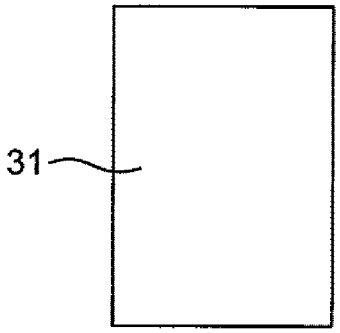
FIGS. 9A and 9B are explanatory views illustrating a method for producing the multilayer coil component according to the embodiment illustrated in FIG. 1 and illustrate the stacking order and the shape of layers.
Figure 10A:
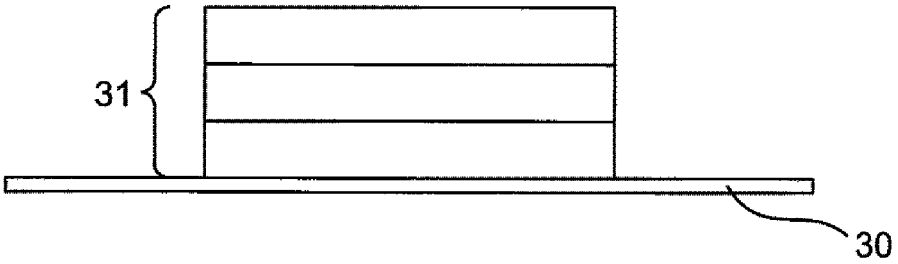
FIGS. 10A to 10D are explanatory views illustrating the method for producing the multilayer coil component according to the embodiment illustrated in FIG. 1 and illustrate the cross-sectional shape of a portion of the coil conductor.

A thermal release sheet and a polyethylene terephthalate (PET) film are stacked on a metal plate. The magnetic sheet is preliminarily pressure-bonded thereto, thereby forming a stacked magnetic sheet 31 (FIGS. 9A and 10A). This layer corresponds to an outer layer of a multilayer coil component.

Figure 9B:
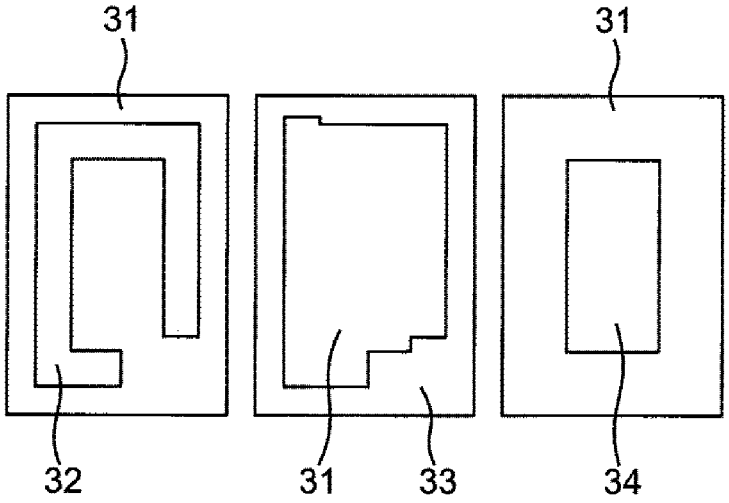
Figure 10B:
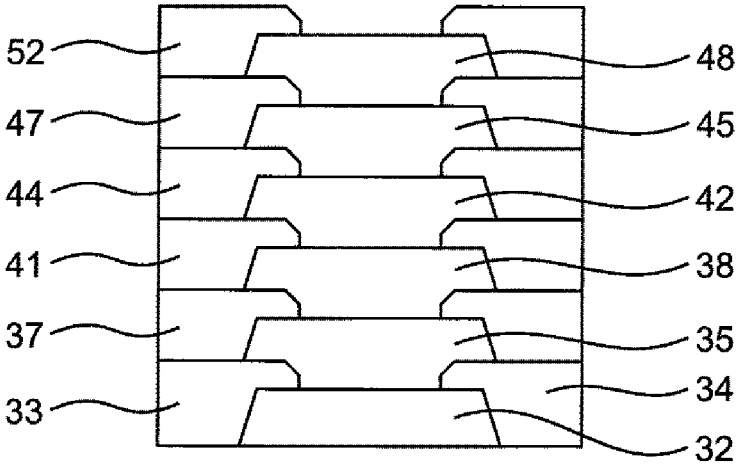

A first conductive paste layer 32 is formed on the stacked magnetic sheet 31 using the first conductive paste. A non-magnetic paste layer 33 is formed on the outer side portion of the first conductive paste layer 32 using the non-magnetic paste so as to overlap the first conductive paste layer 32. A magnetic paste layer 34 is formed at the inner side portion of the first conductive paste layer 32 using the magnetic paste so as to overlap the first conductive paste layer 32 (FIGS. 9B and 10B). These layers can be formed by a known method such as screen printing.

Figure 9C:
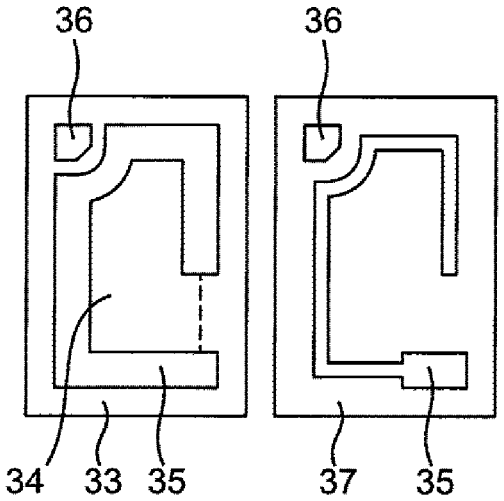
FIGS. 9C and 9D are explanatory views illustrating the method for producing the multilayer coil component according to the embodiment illustrated in FIG. 1 and illustrate the stacking order and the shape of layers.

A second conductive paste layer 35 is formed on the first conductive paste layer 32. The non-magnetic paste layer 33 is interposed at the outer edge portion of a region where the first conductive paste layer 32 and the second conductive paste layer 35 overlap each other. Simultaneously, a second conductive paste layer 36 for lead electrodes are formed. A magnetic paste layer 37 is formed thereon in such a manner that the second conductive paste layers 35 and 36 are exposed (FIGS. 9C and 10B). The first conductive paste layer 32 and the second conductive paste layer 35 correspond to the uppermost conductive layer 7 illustrated in FIG. 4. The non-magnetic paste layer 33 corresponds to the non-magnetic layer 14 located at the outer side portion of the winding section 4.

Figure 9D:
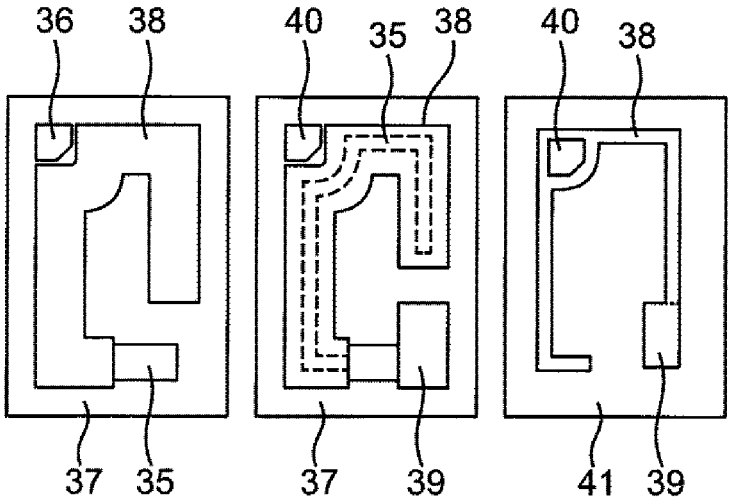

A non-magnetic paste layer 38 is formed so as to cover the exposed second conductive paste layer 35. First conductive paste layers 39 and 40 are formed on the second conductive paste layers 35 and 36. A magnetic paste layer 41 is formed thereon in such a manner that the first conductive paste layers 39 and 40 and the non-magnetic paste layer 38 are exposed (FIGS. 9D and 10B). The non-magnetic paste layer 38 corresponds to one of the non-magnetic layers 14 disposed between the conductive layers 7 illustrated in FIG. 4.

First conductive paste layers 42 and 43 are formed so as to cover the non-magnetic paste layer 38 and the first conductive paste layer 40 exposed through openings in the magnetic paste layer 41. A magnetic paste layer 44 is formed thereon in such a manner that the first conductive paste layers 42 and 43 are exposed (FIGS. 9E and 10B).

Second conductive paste layers 45 and 46 are formed so as to cover the first conductive paste layers 42 and 43 exposed through openings in the magnetic paste layer 44. A magnetic paste layer 47 is formed thereon in such a manner that the second conductive paste layers 45 and 46 are exposed (FIGS. 9F and 10B).

A non-magnetic paste layer 48 is formed so as to overlap the second conductive paste layers 45 and 46 exposed through openings in the magnetic paste layer 47. First conductive paste layers 50 and 51 are formed on the second conductive paste layers 45 and 46. A magnetic paste layer 52 is formed thereon in such a manner that the first conductive paste layers 50 and 51 and the non-magnetic paste layer 48 are exposed (FIGS. 9G and 10B).

Figure 9E:
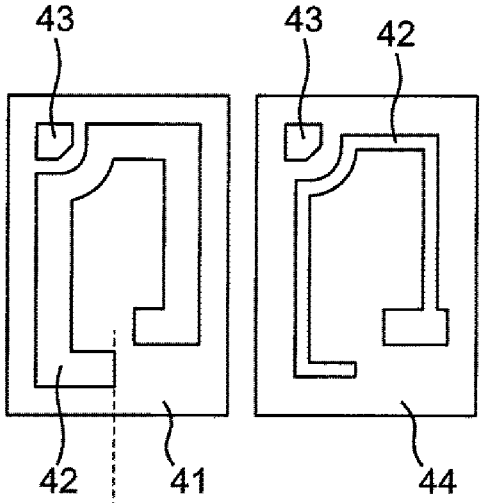
FIGS. 9E to 9G are explanatory views illustrating the method for producing the multilayer coil component according to the embodiment illustrated in FIG. 1 and illustrate the stacking order and the shape of layers.
Figure 9F:
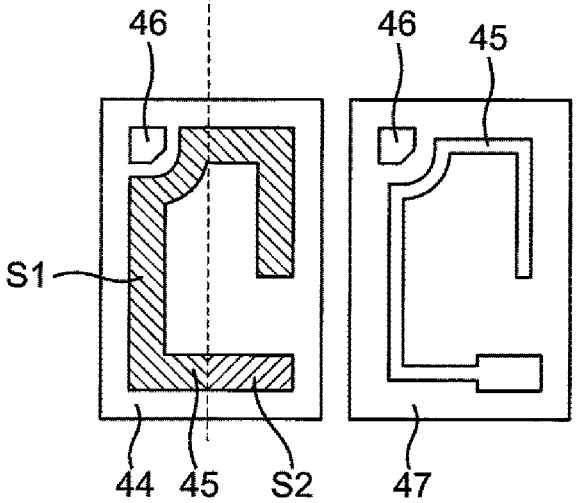
Figure 9G:
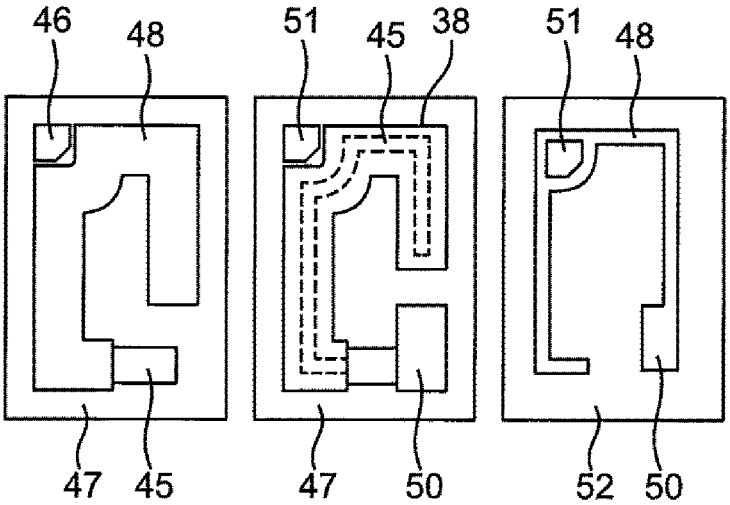

The winding section of the coil conductor 3 is formed by repeating the steps illustrated in FIGS. 9E to 9G a predetermined number of times.

The first conductive paste layer 42 includes an overlapping portion 51 that overlaps with the second conductive paste layer 45 and a non-overlapping portion S2 that does not overlap with the second conductive paste layer 45 when viewed in plan, and the second conductive paste layer 45 includes an overlapping portion 51 that overlaps with the first conductive paste layer 42 and a non-overlapping portion S2 that does not overlap with the first conductive paste layer 42 when viewed in plan. A first conductive paste layer 50 (connection conductor paste layer) is formed on the non-overlapping portion of the second conductive paste layer 45 in order to connect the second conductive paste layer 45 to a first conductive paste layer to be subsequently formed.

Figure 9H:
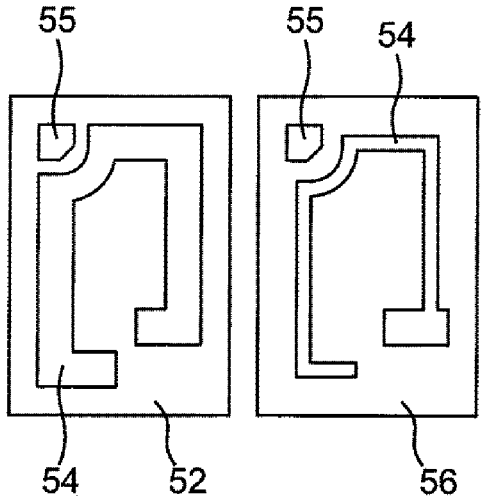
FIGS. 9H and 9I are explanatory views illustrating the method for producing the multilayer coil component according to the embodiment illustrated in FIG. 1 and illustrate the stacking order and the shape of layers.
Figure 10C:
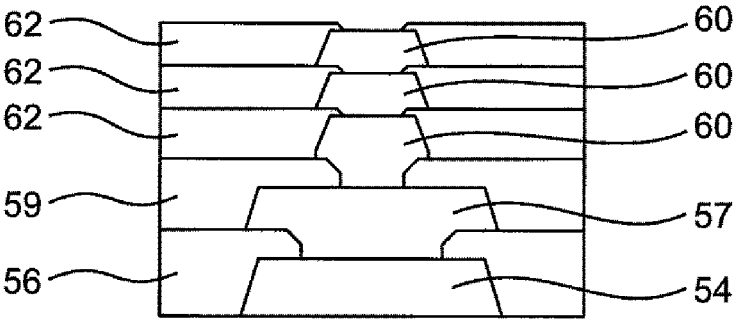

First conductive paste layers 54 and 55 are formed on the non-magnetic paste layer 48 and the first conductive paste layers 50 and 51 exposed through openings in the magnetic paste layer 52. A magnetic paste layer 56 is formed thereon in such a manner that the first conductive paste layers 54 and 55 are exposed (FIGS. 9H and 10C).

Figure 9I:
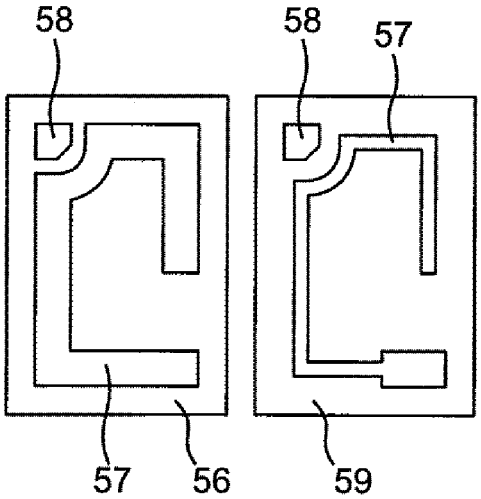

Second conductive paste layers 57 and 58 are formed so as to cover the first conductive paste layers 54 and 55 exposed through an opening in the magnetic paste layer 56. A magnetic paste layer 59 is formed thereon in such a manner that the second conductive paste layers 57 and 58 are exposed (FIGS. 9I and 10C).

Figure 9J:
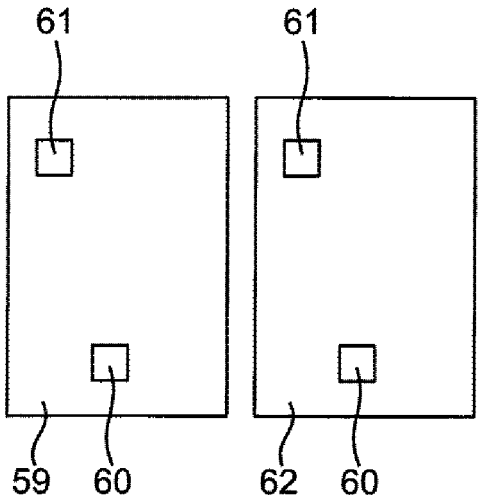
FIGS. 9J and 9K are explanatory views illustrating the method for producing the multilayer coil component according to the embodiment illustrated in FIG. 1 and illustrate the stacking order and the shape of layers.
Figure 10D:
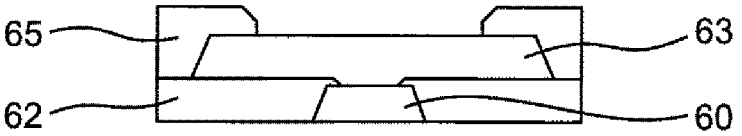

Conductive paste layers 60 and 61 are formed so as to cover the second conductive paste layers 57 and 58 exposed through openings in the magnetic paste layer 59. A magnetic paste layer 62 is formed on a portion other than portions where the conductive paste layers 60 and 61 are formed (FIGS. 9J and 10D). The formation of the conductive paste layers 60 and 61 and the magnetic paste layer 62 is repeated a predetermined number of times to form lead electrodes and a lower exterior. As the conductive paste layers 60 and 61, the first conductive paste layer and the second conductive paste layer are alternately used.

Figure 9K:
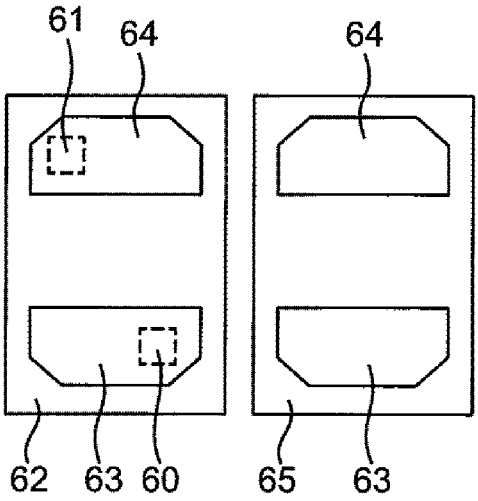

Underlying electrodes 63 and 64 are formed so as to be connected to the conductive paste layers 60 and 61, respectively. A magnetic paste layer 65 is formed around the underlying electrodes 63 and 64 (FIG. 9K).

Articles formed by printing through the steps illustrated in FIGS. 9A to 9K are detached from the metal plate by heating. The articles are subjected to pressure bonding (main pressure bonding). Removal of the PET film results in a collection of elements.

The resulting collection of the elements is separated into individual elements. A method for separating the collection into individual elements is not particularly limited. For example, the separation can be performed with a dicing machine.

The resulting elements are subjected to barrel processing to round the corners of the elements. The barrel processing may be performed for unfired or fired multilayer bodies. The barrel processing may be either wet or dry. The barrel processing may be a method in which the elements are rubbed against each other or a method in which barrel processing is performed with media.

The elements are fired. The firing temperature may be, for example, about 800° C. or higher and about 1,000° C. or lower (i.e., from about 800° C. to about 1,000° C.), preferably about 880° C. or higher and about 920° C. or lower (i.e., from about 880° C. to about 920° C.).

After the firing, plating layers are formed on the underlying electrodes 63 and 64.

A plating method may be electroplating treatment or electroless plating treatment. Preferably, electroplating treatment is used.

In this way, the multilayer coil component 1 according to the embodiment is produced.

While the magnetic paste and the non-magnetic paste (hereinafter, also referred to collectively as a "ferrite paste") are both used in this embodiment, the present disclosure is not limited thereto. In the present disclosure, the ferrite paste layer may be formed using the ferrite paste. For example, only the magnetic paste may be used.

While the embodiments of the present disclosure are described above, the present disclosure is not limited to these embodiments, and various modifications can be made.

EXAMPLES

Magnetic Paste

To prepare a magnetic material, $Fe_2O_3$, ZnO, CuO, and NiO were weighed so as to achieve proportions described below.

$Fe_2O_3$: about 48.0% by mole
ZnO: about 25.0% by mole
CuO: about 9.0% by mole
NiO: balance The weighed substances were placed in a pot mill composed of vinyl chloride together with deionized water and partially stabilized zirconia (PSZ) balls. The mixture was sufficiently mixed and pulverized by a wet process. The pulverized mixture was evaporated to dryness. The dry mixture was calcined at about 750° C. for about 2 hours. The resulting calcined powder was kneaded with predetermined amounts of a ketone-based solvent, polyvinyl acetal, and an alkyd-based plasticizer using a planetary mixer and dispersed using a three-roll mill to prepare a magnetic paste.

Non-Magnetic Paste

To prepare a non-magnetic material, $Fe_2O_3$, CuO, and ZnO were weighed so as to achieve proportions as described below.

$Fe_2O_3$: about 48.0% by mole

CuO: about 9.0% by mole

ZnO: balance

The weighed substances were placed in a pot mill composed of vinyl chloride together with deionized water and partially stabilized zirconia (PSZ) balls. The mixture was sufficiently mixed and pulverized by a wet process. The pulverized mixture was evaporated to dryness. The dry mixture was calcined at about 750° C. for about 2 hours. The resulting calcined powder was kneaded with predetermined amounts of a ketone-based solvent, polyvinyl acetal, and an alkyd-based plasticizer using a planetary mixer and dispersed using a three-roll mill to prepare a non-magnetic paste.

Conductive Paste

As conductive pastes for a coil conductor, two types of conductive pastes having different shrinkages during firing were provided. Silver was used as a conductive material. The shrinkage was adjusted by changing a pigment volume concentration (PVC).

Conductive paste 1: a shrinkage of about 12%

Conductive paste 2: a shrinkage of about 22%

Paste for Underlying Electrode

As a paste for underlying electrodes, a silver paste containing about 1.0% by mass of a glass component was provided.

A multilayer body was produced in the same way as in the foregoing embodiment using the magnetic paste, the non-magnetic paste, the conductive paste 1, and the conductive paste 2 (FIGS. 9A to 9K). Regarding the underlying electrodes, the side-gap distance was about 35 μm, and the extension distance was about 75 μm.

Comparative Example

A multilayer body of a comparative example was produced as in the example, except that the underlying electrodes were formed so as to extend to the end portions of the body and that no magnetic layer extends on each underlying electrode.

Evaluation

A predetermined number of the multilayer bodies (before firing) produced as described above were placed in a pot composed of vinyl chloride and were subjected to barrel processing by rotating the pot to allow the multilayer bodies to rub against each other. After the barrel processing, observation of 30 samples of each of the example and the comparative example under an optical microscope revealed the following: In all the samples of the comparative example, the end portions of the underlying electrodes were chipped or peeled. In contrast, in the samples of the example, no peeling or the like of the underlying electrodes was observed.

The present disclosure includes, but is not limited to, the following aspects.

1. A multilayer coil component includes a body including laminated ferrite layers, a coil conductor including conductive layers laminated in the body, and a pair of outer electrodes disposed on the lower surface of the body. Each of the pair of outer electrodes is electrically connected to a corresponding one of end portions of the coil conductor, in which each of the outer electrodes includes an underlying electrode and a plating layer disposed on the underlying electrode, and the underlying electrode is disposed at a distance from a side surface of the body.

2. In the multilayer coil component according to aspect 1, a distance between the underlying electrode and the side surface of the body is about 5 μm or more and about 100 μm or less (i.e., from about 5 μm to about 100 μm).

3. In the multilayer coil component according to aspect 1 or 2, the underlying electrode has a cutout portion close to a corner portion of the body when viewed in plan.

4. In the multilayer coil component according to any one of aspects 1 to 3, at least one of the ferrite layers of the body extends on an outer edge portion of the underlying electrode across a boundary with the underlying electrode.

5. In the multilayer coil component according to any one of aspects 1 to 4, an extension distance of the at least one of the ferrite layers on the underlying electrode is about 10 μm or more and about 90 μm or less (i.e., from about 10 μm to about 90 μm).

6. In the multilayer coil component according to any one of aspects 1 to 5, at an outer edge portion of the plating layer, the at least one of the ferrite layers is interposed between the plating layer and the underlying electrode.

7. In the multilayer coil component according to any one of aspects 1 to 6, the underlying electrode is composed of Ag, and the plating layer is composed of Ni and Sn.

8. In the multilayer coil component according to any one of aspects 1 to 7, the coil conductor has an axis extending in the vertical direction of the multilayer coil component and has an upper end portion connected to one of the outer electrodes through a lead electrode disposed at an outer side portion of a winding section of the coil conductor.

9. In the multilayer coil component according to any one of aspects 1 to 8, the lead electrode has a cutout portion close to the coil conductor when viewed in plan.

10. In the multilayer coil component according to any one of aspects 1 to 9, the underlying electrode contains a conductive metal and a glass component.

11. In the multilayer coil component according to any one of aspects 1 to 10, the underlying electrode has a glass component content of about 0.8% or more by mass and about 1.2% or less by mass (i.e., from about 0.8% by mass to about 1.2% by mass) with respect to the total of the conductive metal and the glass component.

The multilayer coil component provided by the present disclosure can be used for various applications, for example, in various electronic devices.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. A multilayer coil component comprising:

a body including laminated ferrite layers;

a coil conductor including conductive layers laminated in the body; and a pair of outer electrodes disposed on a lower surface of the body, each of the pair of outer electrodes being electrically connected to a corresponding one of end portions of the coil conductor, wherein each of the outer electrodes includes an underlying electrode and a plating layer disposed on each of the underlying electrodes, each underlying electrode is disposed at a distance from a side surface of the body, each end of each underlying electrode is further from the lower surface of the body than a middle portion of each underlying electrode, and at an outer edge portion of each plating layer which is at an outer perimeter in a longitudinal direction of each plating layer, at least one of the ferrite layers extends onto a surface of the outer edge portion, the surface of the outer edge portion faces an adjacent underlying electrode, and the at least one of the ferrite layers is interposed between each plating layer and each underlying electrode.

2. The multilayer coil component according to claim 1, wherein a distance between each underlying electrode and the side surface of the body is from 5 μm to 100 μm.

3. The multilayer coil component according to claim 1, wherein each underlying electrode has a cutout portion close to a corner portion of the body when viewed in plan.

4. The multilayer coil component according to claim 1, wherein an extension distance of the at least one of the ferrite layers on each underlying electrode is from 10 μm to 90 μm.

5. The multilayer coil component according to claim 1, wherein each underlying electrode is composed of Ag, and each plating layer is composed of Ni and Sn.

6. The multilayer coil component according to claim 1, wherein the coil conductor has an axis extending in a vertical direction of the multilayer coil component and has an upper end portion connected to one of the outer electrodes through a lead electrode disposed at an outer side portion of a winding section of the coil conductor.

7. The multilayer coil component according to claim 6, wherein the lead electrode has a cutout portion close to the coil conductor when viewed in plan.

8. The multilayer coil component according to claim 1, wherein each underlying electrode contains a conductive metal and a glass component.

9. The multilayer coil component according to claim 1, wherein each underlying electrode has a glass component content of from 0.8% by mass to 1.2% by mass with respect to the total of the conductive metal and the glass component.

10. The multilayer coil component according to claim 2, wherein each underlying electrode has a cutout portion close to a corner portion of the body when viewed in plan.

11. The multilayer coil component according to claim 2, wherein at least one of the ferrite layers of the body extends on an outer edge portion of each underlying electrode across a boundary with each underlying electrode.

12. The multilayer coil component according to claim 2, wherein an extension distance of the at least one of the ferrite layers on each underlying electrode is from 10 μm to 90 μm.

13. The multilayer coil component according to claim 2, wherein at an outer edge portion of each plating layer, the at least one of the ferrite layers is interposed between each plating layer and each underlying electrode.

14. The multilayer coil component according to claim 2, wherein each underlying electrode is composed of Ag, and each plating layer is composed of Ni and Sn.

15. The multilayer coil component according to claim 2, wherein the coil conductor has an axis extending in a vertical direction of the multilayer coil component and has an upper end portion connected to one of the outer electrodes through a lead electrode disposed at an outer side portion of a winding section of the coil conductor.

16. The multilayer coil component according to claim 15, wherein the lead electrode has a cutout portion close to the coil conductor when viewed in plan.

17. The multilayer coil component according to claim 2, wherein each underlying electrode contains a conductive metal and a glass component.

18. The multilayer coil component according to claim 2, wherein each underlying electrode has a glass component content of from 0.8% by mass to 1.2% by mass with respect to the total of the conductive metal and the glass component.

19. The multilayer coil component according to claim 1, wherein a width of each plating layer taken in a direction along which the lower surface of the body extends is less than a width of each underlying electrode taken in the direction along which the lower surface of the body extends.

* * * * *